US009010400B2

(12) United States Patent
Chen

(10) Patent No.: US 9,010,400 B2
(45) Date of Patent: Apr. 21, 2015

(54) COVERING DEVICE AND COUPLING MODULE THEREOF

(71) Applicant: Nien Made Enterprise Co., Ltd., Taichung (TW)

(72) Inventor: Lin Chen, Taichung (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 0 days.

(21) Appl. No.: 13/927,594

(22) Filed: Jun. 26, 2013

(65) Prior Publication Data

US 2014/0166219 A1 Jun. 19, 2014

(30) Foreign Application Priority Data

Dec. 19, 2012 (CN) ..... 2012 2 0707370 U

(51) Int. Cl.
*E06B 9/24* (2006.01)
*E06B 9/266* (2006.01)

(52) U.S. Cl.
CPC ..... *E06B 9/266* (2013.01)

(58) Field of Classification Search
CPC ..... E06B 9/327; E06B 2009/2622; E06B 2009/2625; E06B 2009/2627
USPC ..... 160/84.06, 84.04, 84.05, 84.03, 84.231, 160/280–288, 120, 241, 167 R, 172 R, 160/178.1 R
See application file for complete search history.

(56) References Cited

U.S. PATENT DOCUMENTS

| | | | | | |
|---|---|---|---|---|---|
| 1,887,646 | A | * | 11/1932 | Johnston | 160/243 |
| 2,181,101 | A | * | 11/1939 | Spenard | 160/349.1 |
| 2,187,242 | A | * | 1/1940 | Kesner | 160/172 R |
| 3,156,294 | A | * | 11/1964 | Miller et al. | 160/173 R |
| 4,444,239 | A | * | 4/1984 | Haines | 160/107 |
| 4,541,469 | A | * | 9/1985 | Dressell | 160/178.1 R |
| 4,553,353 | A | | 11/1985 | Simpson | |
| 4,601,319 | A | * | 7/1986 | Georgopoulos | 160/178.1 R |
| 4,807,686 | A | * | 2/1989 | Schnebly et al. | 160/84.02 |
| 4,880,045 | A | * | 11/1989 | Stahler | 160/84.04 |
| 4,945,969 | A | * | 8/1990 | Schnebly et al. | 160/84.02 |
| 5,111,866 | A | * | 5/1992 | Prostko | 160/90 |
| 5,141,041 | A | * | 8/1992 | Katz et al. | 160/84.02 |
| 5,275,221 | A | * | 1/1994 | Doehlemann | 160/84.04 |
| 6,186,211 | B1 | * | 2/2001 | Knowles | 160/84.02 |
| 6,186,214 | B1 | * | 2/2001 | Ladd et al. | 160/178.1 R |
| 2003/0178159 | A1 | | 9/2003 | David | |
| 2004/0128916 | A1 | | 7/2004 | Fullick | |
| 2007/0157521 | A1 | | 7/2007 | Ito et al. | |

FOREIGN PATENT DOCUMENTS

DE 202012010976 12/2012

* cited by examiner

*Primary Examiner* — David Purol
(74) *Attorney, Agent, or Firm* — Ming Chow; Sinorica, LLC

(57) ABSTRACT

A coupling device of a shading member, includes a frame and two coupling modules. Each coupling module includes a main member fixed to a top or a bottom of the shading member, two positioning members connected to the main member, and two controlling members connected to the positioning members. The positioning members are received in the main member, each of which has a gear to engage a rack of the frame. The positioning members are movable by moving the controlling members to make the gears engage or disengage the racks. As a result, the shading member is able to be assembled or disassembled in an easy way.

19 Claims, 8 Drawing Sheets

COVERING DEVICE AND COUPLING MODULE THEREOF

The current application claims a foreign priority to the patent application of China No. 201220707370.5 filed on Dec. 19, 2012.

BACKGROUND OF THE INVENTION

1. Technical Field

The present invention relates to a door or a window, and more particularly to a covering device for a door or a window, and a coupling module of the covering device.

2. Description of Related Art

Glass windows are the commonest window in the present market. The transparent glass allows light to emit into the building. Typically, the glass window is equipped with a covering device to shade the room from light or for privacy.

Some windows are capable of heat insulation. The heat insulation window usually has two glasses which enclosed a vacuum. However, this kind of window still needs a covering device for the above purposes.

Some heat insulation windows are equipped with a shade member, such as slats or plates, therefore it has all the functions above. However, such window usually has a complex structure, and is hard to be repaired if the shade member malfunctioned.

BRIEF SUMMARY OF THE INVENTION

In view of the above, the primary objective of the present invention is to provide a covering device and a coupling module of the covering device, which provides the window or door both functions of heat insulation and shading. It further makes the job of mounting and taking off the covering device easier.

In order to achieve the objective of the present invention, a coupling device of a shading member is introduced here, includes two elongated engaging members, which are separated and parallel; a main member between the coupling members, and two positioning members connected to the main member. The main member has two openings facing the coupling members respectively. Each positioning member has a gear engaging the engaging member, and at least one of the positioning members is movable relative to the main member. The movable positioning member is connected with a controlling member to be moved between a first position and a second position. The gear of the movable positioning member disengages the engaging member when the controlling member is moved to the first position, and the gear of the movable positioning member is moved out of the main member via the opening to engage the engaging member when the controlling member is moved to the second position.

In an embodiment, the main member is provided with a guiding slot on a side thereof; the controlling member is connected to the movable positioning member through the guiding slot, and the controlling member moves along the guiding slot between the first position and the second position.

In an embodiment, the coupling device further includes a shaft received in the main member and connected to the positioning members to make the gears of the positioning members rotate simultaneously.

In an embodiment, the shaft has a cross section, which is not round; and the positioning member has a recess fitting the shaft, whereby the gears of the positioning member is able to reciprocate relative to the shaft and rotate with the shaft.

In an embodiment, the coupling device further includes two pushing members received in the recesses of the positioning members, wherein each pushing member is between a bottom of the recess and the shaft to urge the positioning member toward the corresponding engaging member.

In an embodiment, the movable positioning member has a flange; and the controlling member has a ring fitting the movable positioning member and against the flange.

In an embodiment, the main member is provided with a plurality of reinforced plates to press the movable positioning members respectively.

In an embodiment, the coupling device further includes a frame, on which the engaging members are provided, wherein the frame has two slots besides the engaging members respectively; and the main members has two protrusions engaging the slots respectively.

In an embodiment, the coupling device further includes two flexible members engaging the protrusions and urging bottoms of the slots respectively.

In an embodiment, each gear has an inclined face facing the engaging member.

The present invention further provides a coupling module, including a main member, and two positioning members connected to the main member. The main member has two openings at opposite ends. Each positioning member has a gear, and at least one of the positioning members is movable relative to the main member. The movable positioning member is connected with a controlling member to be moved between a first position and a second position. The gear of the movable positioning member is received in the main member when the controlling member is moved to the first position, and the gear of the movable positioning member is moved out of the main member via the opening when the controlling member is moved to the second position.

In an embodiment, the main member is provided with a guiding slot on a side thereof; the controlling member is connected to the movable positioning member through the guiding slot, and the controlling member moves along the guiding slot between the first position and the second position.

In an embodiment, the coupling device further includes a shaft received in the main member and connected to the positioning members to make the gears of the positioning members rotate simultaneously.

In an embodiment, the shaft has a cross section, which is not round; and the positioning member has a recess fitting the shaft, whereby the gears of the positioning member is able to reciprocate relative to the shaft and rotate with the shaft.

In an embodiment, the coupling device further includes two pushing members received in the recesses of the positioning members, wherein each pushing member is between a bottom of the recess and the shaft to urge the positioning member outwards.

In an embodiment, the movable positioning member has a flange; and the controlling member has a ring fitting the movable positioning member and against the flange.

In an embodiment, the main member is provided with a plurality of reinforced plates to press the movable positioning members respectively.

In an embodiment, the gear has an inclined face.

With such design, the window with the shading member has all the functions as described above, and furthermore the shading member is able to be assembled or disassembled in an easy way.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
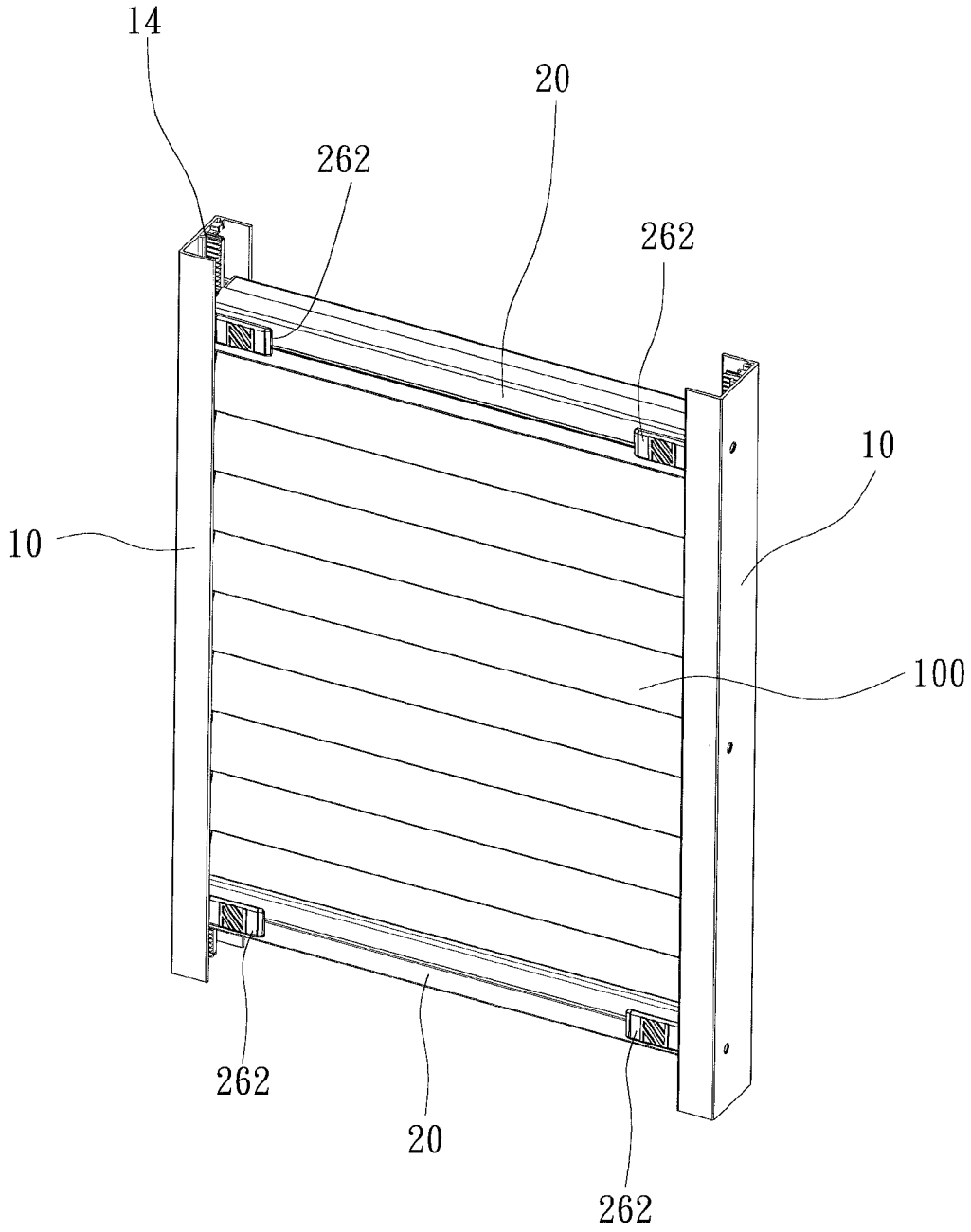
FIG. 1 is a perspective view of a first preferred embodiment of the present invention.

As shown in FIG. 1, a coupling device of the first preferred embodiment of the present invention is used to couple a retractable shading member 100 to a frame. The coupling device has two coupling modules 20 and a frame.

Figure 2:
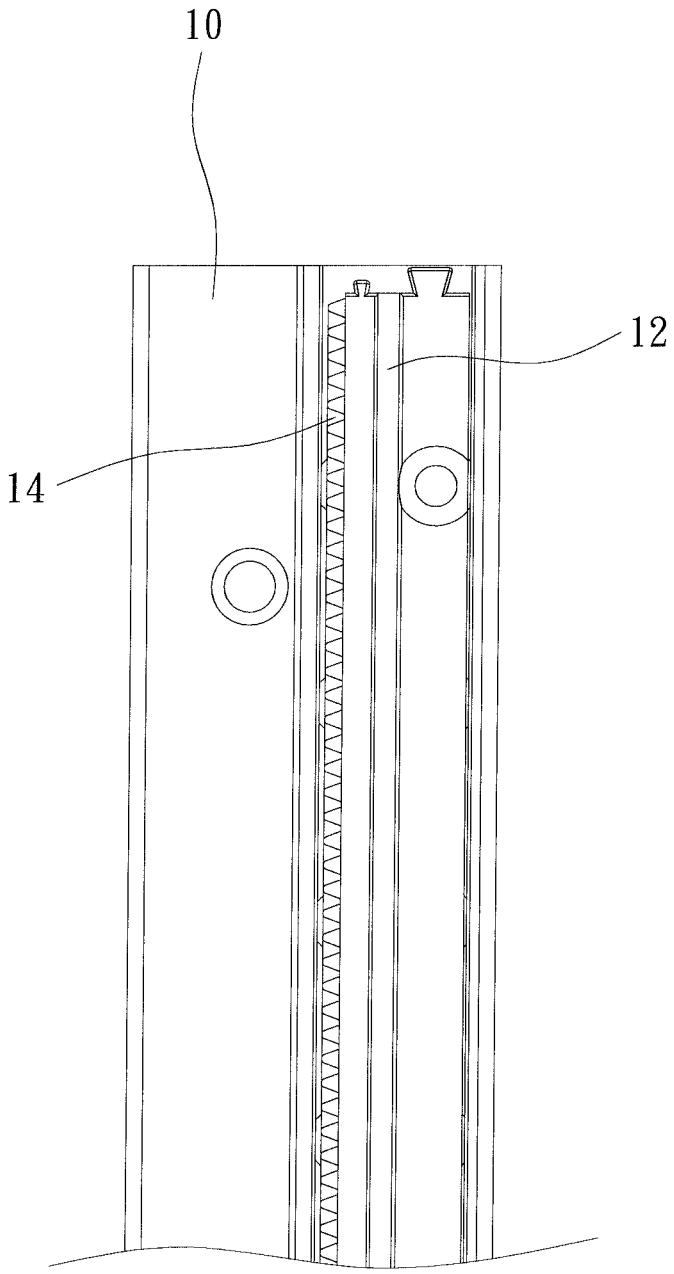
FIG. 2 is a perspective view of the first preferred embodiment of the present invention, showing the rack and the slot of the frame.

The frame has two parallel rails 10. As shown in FIG. 2, each rail 10 has a slot 12 and an engaging member 14. In an embodiment, the engaging member 14 is a rack beside the slot 12. The slot 12 and the engaging member 14 in one rail are aligned with the slot 12 and the engaging member 14 on the other rail 10.

Figure 3:
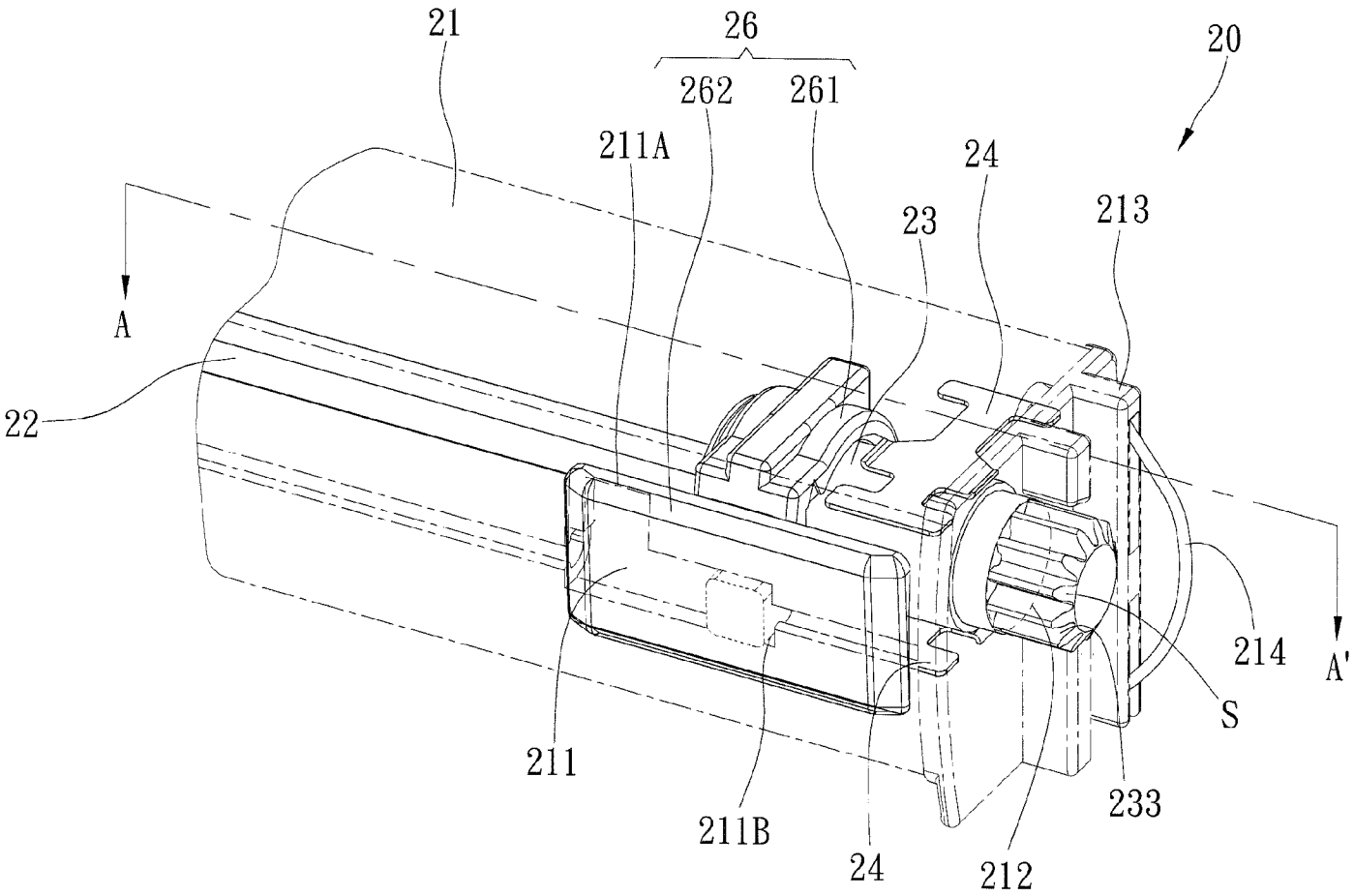
FIG. 3 is a perspective view of the coupling module of the first preferred embodiment of the present invention.
Figure 4:
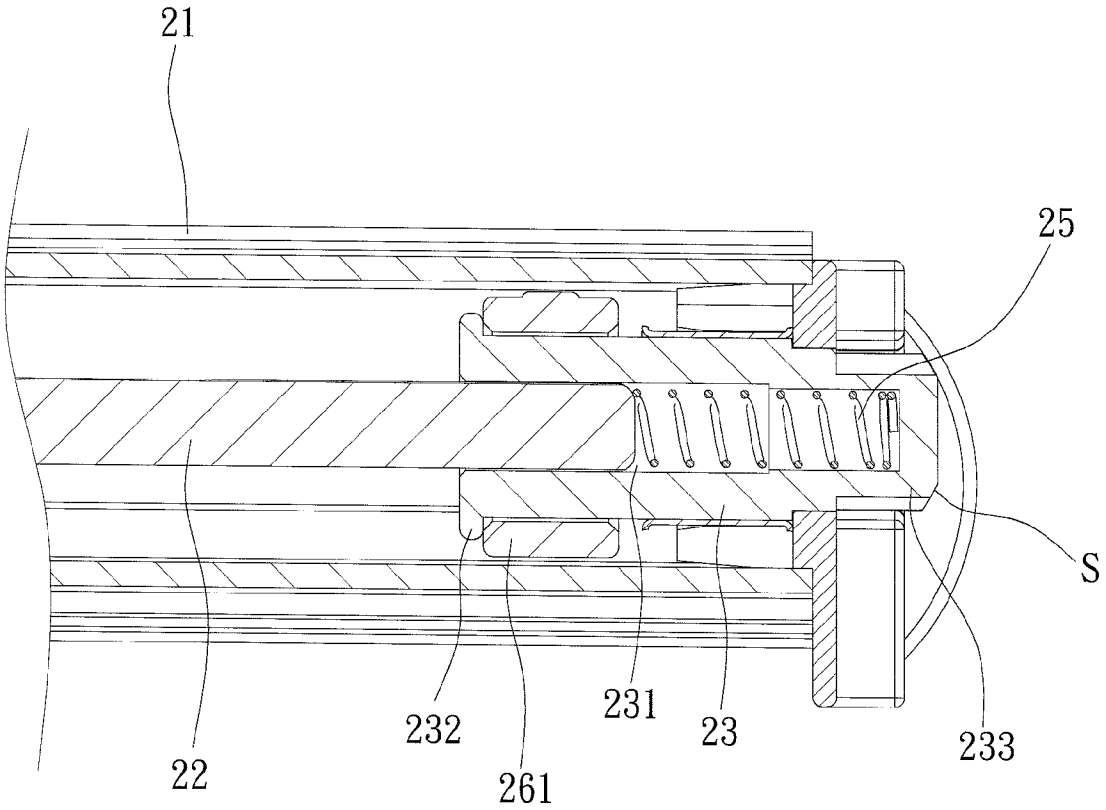
FIG. 4 is a sectional view along the A-A' line of FIG. 3.

The coupling modules 20 are mounted on a top and a bottom of the shading member 100. As shown in FIG. 3 and FIG. 4, each coupling module 20 has a main member 21, a shaft 22, two positioning members 23, four reinforced plates 24, two pushing members 25, and two controlling members 26.

The main members 21 are two rectangular tubular members to be connected to the top and the bottom of the shading member 100. Each main member 21 has two guiding slots 211 on a front side and adjacent to opposite ends thereof. As shown in FIG. 4, the guiding slot 211 has a first end 211A and a second end 211B at opposite ends. The guiding slot 211 is an L-shaped slot having a horizontal section and a vertical section. The first end 211A is on a top of the vertical section, and the second end 211B is on a right of the horizontal section (FIG. 3). The main member 21 further has an opening 212 on each end thereof and a protrusion 213 beside the opening 212. A flexible member 214 engages the protrusion 213. The flexible member 214 is an arched steel wire, and of course, it could be any kind of flexible member.

The shaft 22 is received in the main member 21 for free rotation. In an embodiment, the shaft 22 is has a hexagonal cross section, and it could be triangular, tetragonal, or any shape other than round.

Each positioning member 23 has a recess 231 which fits the shaft 22. The positioning member 23 has a flange 232 around an end where the recess 231 is provided and a gear 233 on the other end. The gear 233 has an inclined face S on teeth thereof. The shaft 22 is inserted into the recess 231 of the positioning member 23, and the gear 233 extends out of the main member 21 via the opening 212. The positioning member 23 is able to move inwards and outwards relative to the shaft 22.

The reinforced plates 24 are made of a rigid material, and are provided in the main member 21. Two of the reinforced plates 24 press one of the positioning members 23 on a top and a bottom thereof, and the other two reinforced plates 24 press the other positioning member 23 in the same way. The reinforced plates 24 provide the positioning members 23 with friction to increase the precision of positioning and stability of the positioning members 23.

In this embodiment, the pushing members 25 are two springs received in the recesses 231 of the positioning members 23 respectively. The pushing members 25 are between bottoms of the recesses 231 and the shaft 22 to urge the positioning members 23 outwards.

Figure 5:
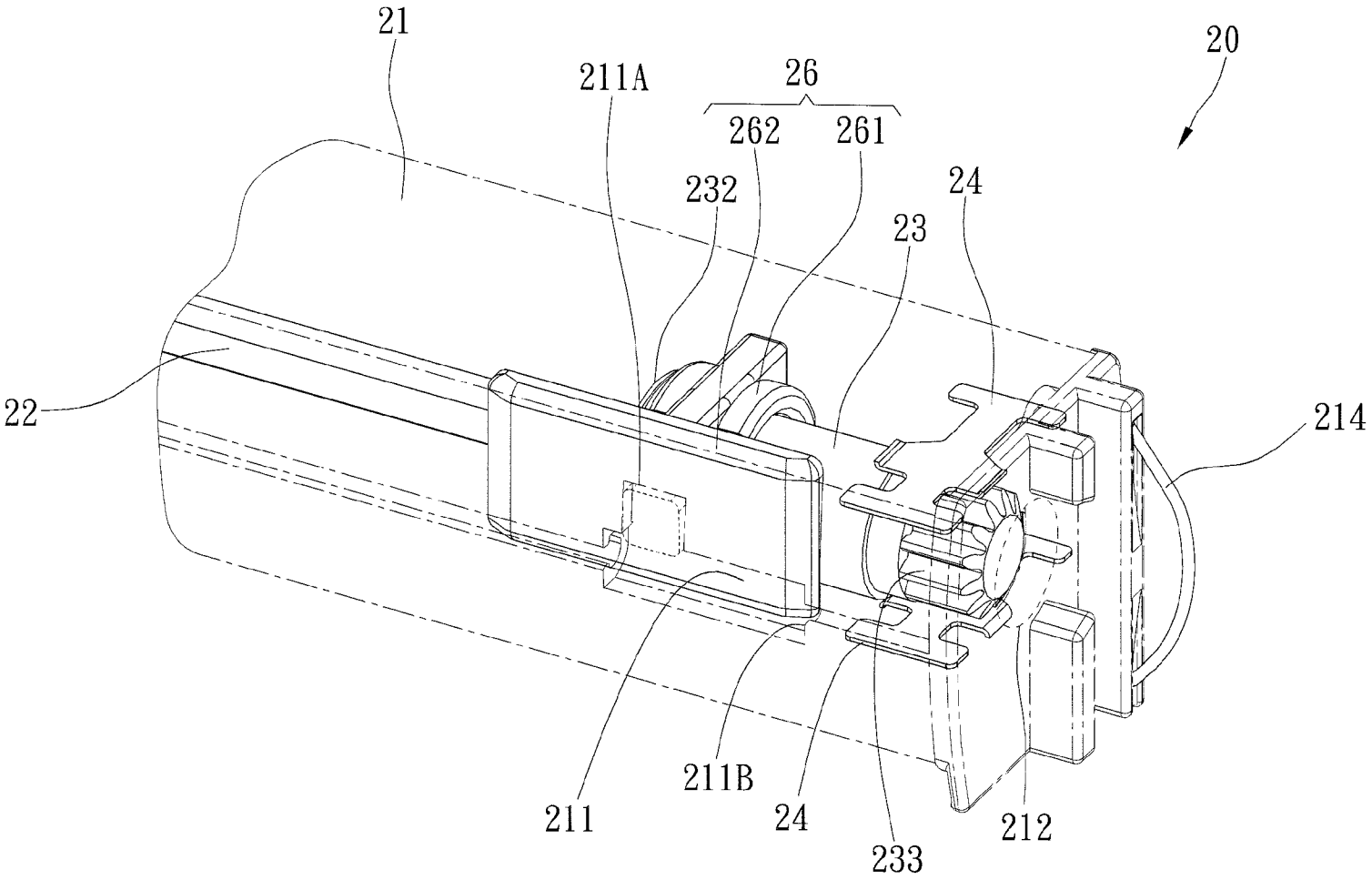
FIG. 5 is a perspective view of the first preferred embodiment of the present invention, showing the controlling member in the first end of the guiding slot.

Each controlling member 26 has a ring 261 and an operating plate 262. The operating plate 262 is outside of the main member 21, and the ring 261 is connected to the operating plate 262 through the guiding slots 211. The ring 261 fits the corresponding positioning member 23 and against the flange 232. A user may move the operating plate 262 between a first position (the controlling member 26 is moved to the first end 211A of the guiding slot 211, FIG. 5) and a second position (the controlling member 26 is moved to the second end 211B of the guiding slot 211, FIG. 3). When the controlling member 26 is moved to the first position, as shown in FIG. 5, the ring 261 moves the positioning member 23 inwards. The controlling member 26 will be held at the first position because of the vertical section of the guiding slot 211. While the controlling member 26 leaves the vertical section of the guiding slot 211, the pushing member 25 will move the positioning member 23 as well as the controlling member 26 outwards until the controlling member 26 arrives at the second position. In the second position, as shown in FIG. 3, the gear 233 extends out of the main member 21 through the opening 212. The pushing member 25 keeps urging the positioning member 23 to hold the controlling member 26 at the second position.

Figure 6:
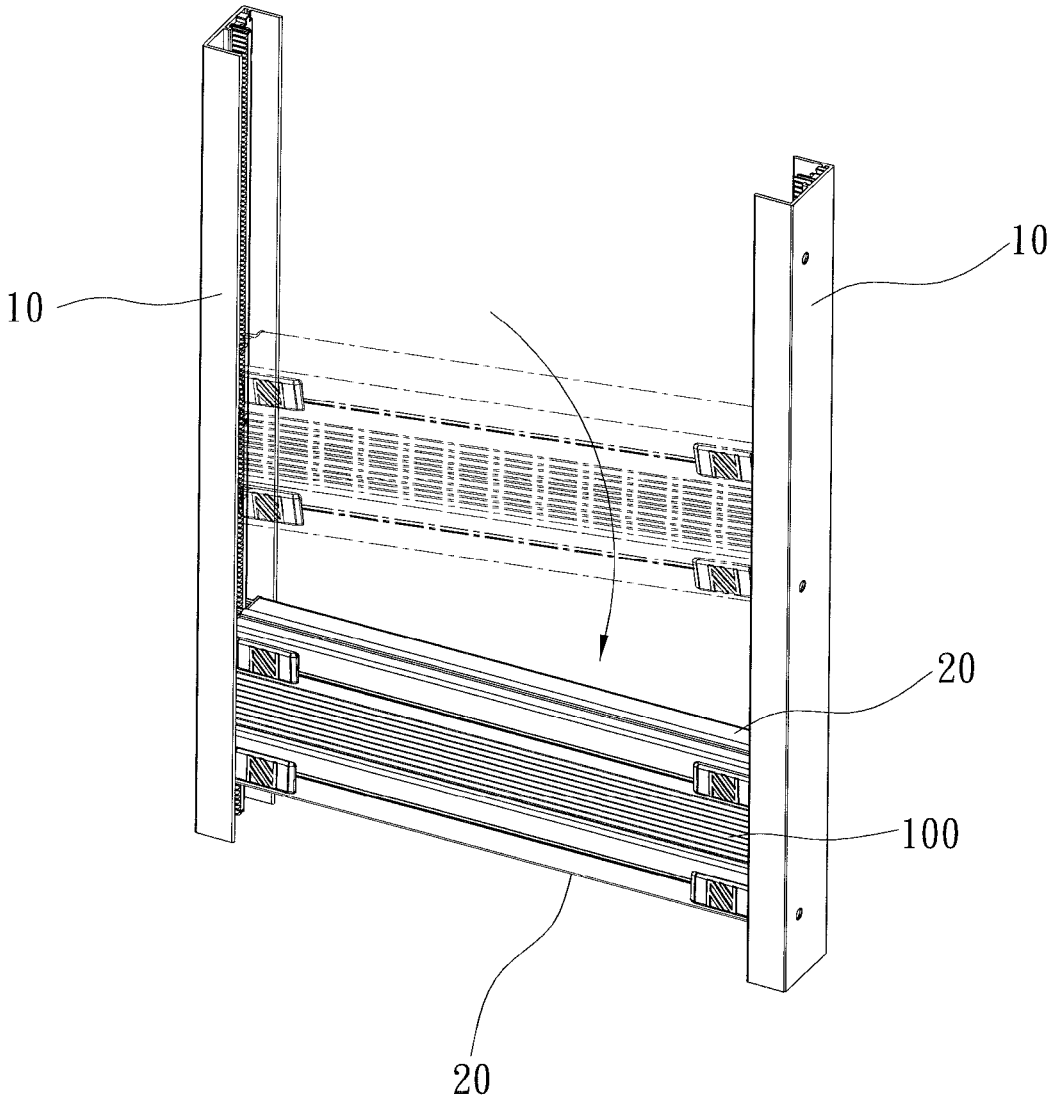
FIG. 6 is a perspective view of the first preferred embodiment of the present invention, showing how to mount the covering device on the frame.
Figure 7:
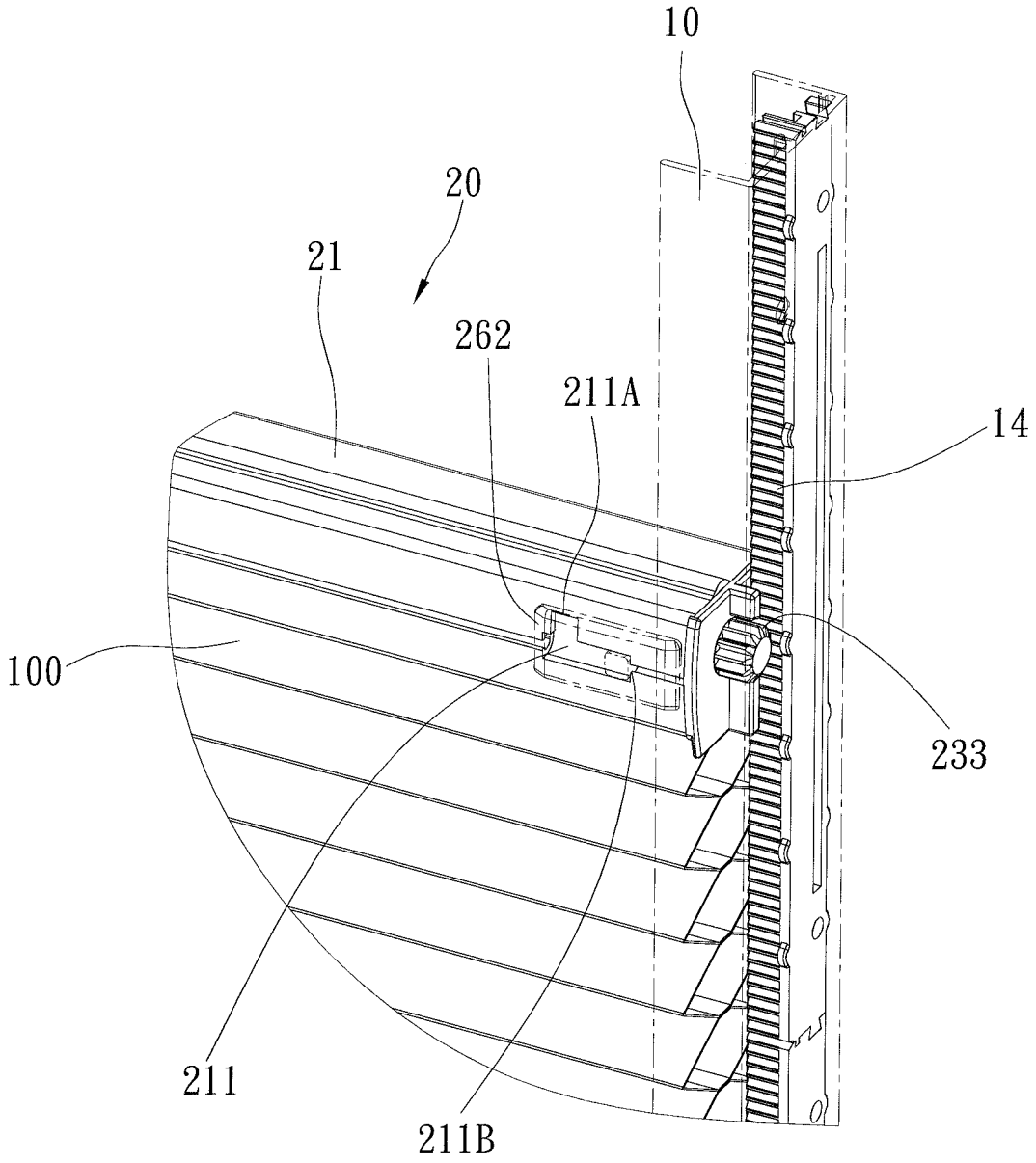
FIG. 7 is a perspective view of the first preferred embodiment of the present invention, showing the protrusion in the through hole.

As shown in FIG. 6, before mount the shading member 100 to the frame, retract the shading member 100 that makes the user to hold both the main members 21, and move the controlling members 26 to the first position to receive the gears 233 in the main member 21. Next, engage the protrusions 213 of the main members 21 with the corresponding slots 12 of the rails 10. The flexible members 214 now will urge bottoms of the slots 12 to stabilize the main members 21. The flexible members 214 will hold the engagements of the protrusions 213 and the slots 12 as well. At this time, the gears 233 are disengaged with the racks 14. Next, as shown in FIG. 7, move the operating plates 262 off the vertical sections of the guiding slots 211, and the pushing members 25 will take over to move the controlling members 26 to the second positions. At this time, the gears 233 are moved out of the main members 21 to engage the corresponding racks 14. There are four gears 233 engaging two racks 14 which make the shading member 100 firmly mounted on the rails 10 and is able to move on the rails 10.

After that, the user may move the main members 21 up or down to extend or retract the shading member 100 (FIGS. 2 and 6). The frame may be mounted on a window or a door, or the frame is a frame of a window or a door. If the user wants to take shading member 100 off the frame, he/she only has to move the operating plates 262 from the second positions to the first position. The gears 233 are moved back into the main members 21, and the shading member 100 may be taken off in a reverse steps.

The shaft 22 makes the gears 233 at the opposite ends thereof rotate simultaneously. Therefore, the main member 21 will keep horizontal when it is moving on the rails. It may provide the main member 21 a smooth movement on the coupling modules 20.

The reinforced plates 24 increase the strength of the main member 21, and keep the positioning members 23 in position while they are rotating. They are helpful to the movement of the main member 21 as well.

The inclined faces S of the gears 233 make the engagement of the gears 233 and the racks 14 easier and faster.

In conclusion, the cover device of the present invention may provide the window or the door all the functions as described in the background. It further makes the shading member to be assembled and disassembled in an easy way.

Figure 8:
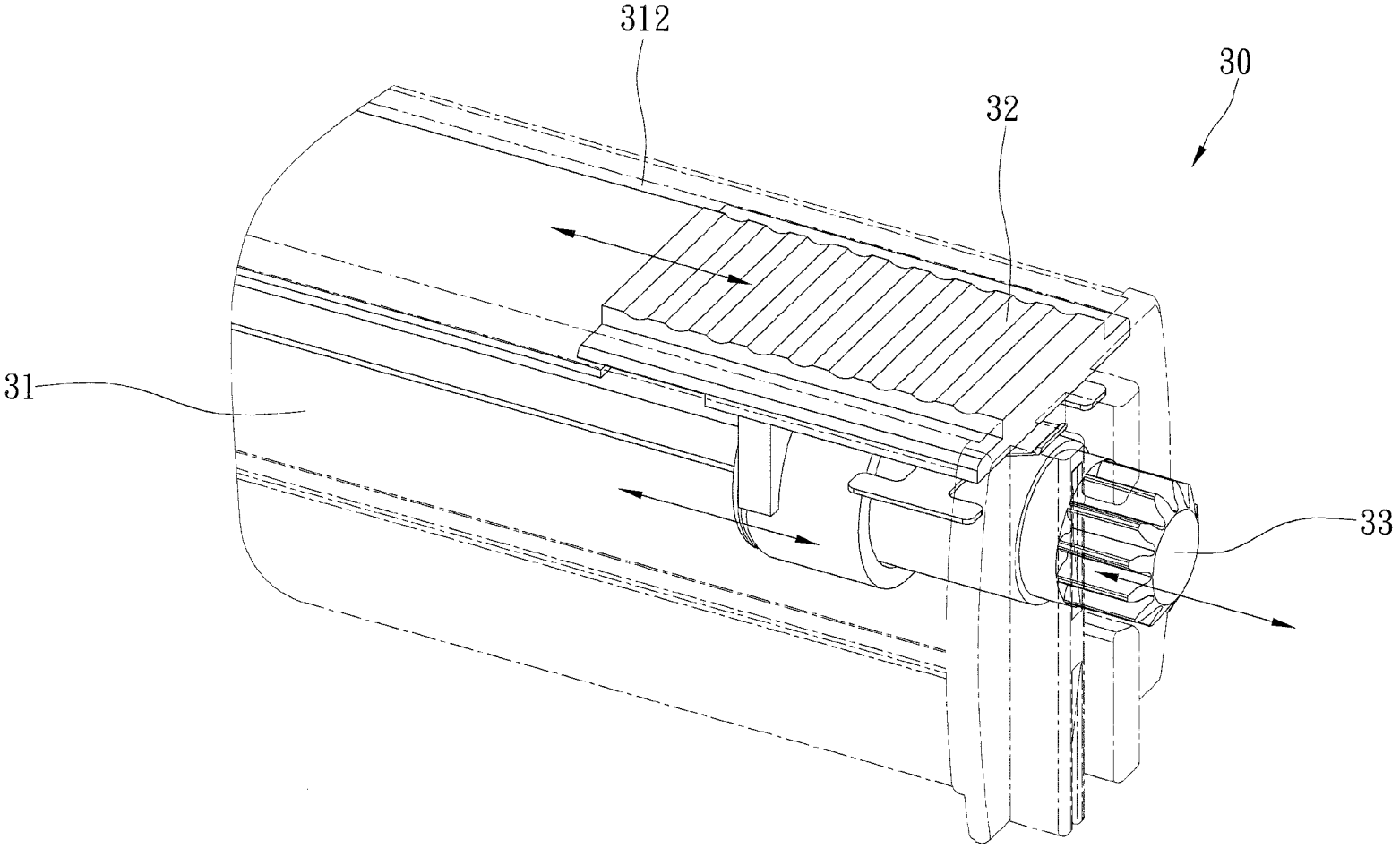
FIG. 8 is a perspective view of a second preferred embodiment of the present invention.

FIG. 8 shows a coupling device of the second preferred embodiment of the present invention, which is similar to the first preferred embodiment, except that guiding slots are on a top or a bottom of the main member 31. Opposite sidewalls of the guiding slot form a pair of tracks 312. The controlling member 32 has a base and a protrusion on the base. The base is wider than the protrusion and the guiding slot, and the guiding slot is slightly wider than the protrusion. The base is under the guiding slot and against the main member 31. The protrusion is in the guiding slot and guided by the tracks 312. The controlling member 32 is operable to move the positioning member 33 as described above.

The shading member may also be slats, a valance, or other equivalent members. The coupling member may be a rack, a chain, or other equivalent members. Each main member may only need one set of the movable positioning member and the controlling member only. It will have the same function. It must be pointed out that the embodiments described above are only some preferred embodiments of the present invention. All equivalent structures which employ the concepts disclosed in this specification and the appended claims should fall within the scope of the present invention.

What is claimed is:

1. A coupling device of a shading member, comprising:

two elongated engaging members, which are separated and parallel;

a main member between the elongated engaging members, has two openings facing the elongated engaging members respectively; and two positioning members connected to the main member, wherein each positioning member has a gear engaging the engaging member, and at least one of the positioning members is movable relative to the main member;

wherein the movable positioning member is connected with a controlling member to be moved between a first position and a second position;

wherein the main member is provided with a guiding slot on a side thereof; the controlling member is connected to the movable positioning member through the guiding slot, and the controlling member moves along the guiding slot between the first position and the second position;

wherein the gear of the movable positioning member disengages the engaging member when the controlling member is moved to the first position, and the gear of the movable positioning member is moved out of the main member via the opening to engage the engaging member when the controlling member is moved to the second position;

wherein the gear of the movable positioning member is totally apart from the engaging member when the controlling member is moved to the first position, and the engaging member crosses the gear of the movable positioning member to separate from the main member.

2. The coupling device of claim 1, further comprising a shaft received in the main member and connected to the positioning members to make the gears of the positioning members rotate simultaneously.

3. The coupling device of claim 2, wherein the shaft has a cross section, which is not round; and the positioning member has a recess fitting the shaft, whereby the gear of the positioning member is able to reciprocate relative to the shaft and rotate with the shaft.

4. The coupling device of claim 3, further comprising two pushing members received in the recesses of the positioning members, wherein each pushing member is between a bottom of the recess and the shaft to urge the positioning member toward the corresponding engaging member.

5. The coupling device of claim 1, wherein the movable positioning member has a flange; and the controlling member has a ring fitting the movable positioning member and against the flange, whereby the movable positioning member is able to rotate related to the controlling member.

6. The coupling device of claim 1, wherein the main member is provided with a plurality of reinforced plates to press the movable positioning members respectively.

7. The coupling device of claim 1, further comprising a frame, on which the engaging members are provided, wherein the frame has two slots besides the engaging members respectively; and the main members has two protrusions engaging the slots respectively.

8. The coupling device of claim 7, further comprising two flexible members engaging the protrusions and urging bottoms of the slots respectively.

9. The coupling device of claim 1, wherein each gear has an inclined face facing the engaging member.

10. A coupling module, comprising:

a main member having two openings at opposite ends; and two positioning members connected to the main member at the openings, wherein each positioning member has a gear, and at least one of the positioning members is movable relative to the main member;

wherein the movable positioning member is connected with a controlling member to be moved between a first position and a second position;

wherein the gear of the movable positioning member is received in the main member when the controlling member is moved to the first position, and the gear of the movable positioning member is moved out of the main member via the opening when the controlling member is moved to the second position;

wherein the controlling member is able to reciprocate, and unable to rotate while the movable positioning member moves along with the controlling member, and rotate related to the controlling member.

11. The coupling module of claim 10, wherein the main member is provided with a guiding slot on a side thereof; the controlling member is connected to the movable positioning member through the guiding slot, and the controlling member moves along the guiding slot between the first position and the second position.

12. The coupling module of claim 10, further comprising a shaft received in the main member and connected to the positioning members to make the gears of the positioning members rotate simultaneously.

13. The coupling module of claim 12, wherein the shaft has a cross section, which is not round; the positioning member has a recess fitting the shaft, whereby the gears of the positioning member is able to reciprocate relative to the shaft and rotate with the shaft.

14. The coupling module of claim 13, further comprising two pushing members received in the recesses of the positioning members, wherein each pushing member is between a bottom of the recess and the shaft to urge the positioning member out of the opening.

15. The coupling module of claim 10, wherein the movable positioning member has a flange; and the controlling member has a ring fitting the movable positioning member and against the flange, whereby the movable positioning member is able to rotate related to the controlling member.

16. The coupling module of claim 10, wherein the main member is provided with a plurality of reinforced plates to press the movable positioning members respectively.

17. The coupling module of claim 10, wherein each gear has an inclined face.

18. The coupling module of claim 1, wherein the main member is provided with a pair of protrusions on each end thereof; a space is formed between the protrusions, in which the engaging member is received; one of the protrusions has a gap, and a part of the opening is in the gap, whereby the gear of the movable positioning member engages the engaging member through the gap.

19. The coupling module of claim 10, wherein the main member is provided with a pair of protrusions on each end thereof; a space is formed between the protrusions; one of the protrusions has a gap, and a part of the opening is in the gap, whereby a part of the gear of the movable positioning member is received in the gap and the space when the controlling member is moved to the first position.

* * * * *